United States Patent [19]

Barat

[11] 4,217,839

[45] Aug. 19, 1980

[54] ADJUSTABLE ANTI-SPILL BOBBIN TENSION SPRING

[75] Inventor: Benedict W. Barat, Linden, N.J.

[73] Assignee: The Singer Company, Stamford, Conn.

[21] Appl. No.: 64,315

[22] Filed: Aug. 6, 1979

[51] Int. Cl.[3] ..... D05B 57/26

[52] U.S. Cl. ..... 112/229; 242/156

[58] Field of Search ..... 112/229, 230, 231; 242/156

[56] References Cited

U.S. PATENT DOCUMENTS

| | | | |
|---|---|---|---|
| 84,065 | 11/1868 | Locke | 242/156 |
| 512,023 | 1/1894 | Hauck | 242/156 |
| 2,555,658 | 6/1951 | Ritter | 112/229 |
| 3,702,102 | 11/1972 | Davidson et al. | 112/229 X |
| 3,767,136 | 10/1973 | Krausse et al. | 242/156 |
| 4,074,645 | 2/1978 | Droste et al. | 112/229 |
| 4,157,691 | 6/1979 | Cerliani | 112/229 |

FOREIGN PATENT DOCUMENTS

| | | | |
|---|---|---|---|
| 2433797 | 1/1976 | Fed. Rep. of Germany | 112/229 |

*Primary Examiner*—Werner H. Schroeder
*Assistant Examiner*—Andrew M. Falik
*Attorney, Agent, or Firm*—Donald P. Gillette; Robert E. Smith; Edward L. Bell

[57] ABSTRACT

An annular disc is forced onto the central sleeve of the sewing machine bobbin case and held in place by the tight interference fit. A set screw within the limited area of the front wall, thick enough to hold the entire length of the screw, can be adjusted from outside the bobbin case to set the braking pressure of the disc against a bobbin flange to prevent excessive rotation of the bobbin and spillage of its thread.

4 Claims, 6 Drawing Figures

ADJUSTABLE ANTI-SPILL BOBBIN TENSION SPRING

BACKGROUND OF THE INVENTION

This invention relates to the field of braking means for sewing machine bobbins, and particularly to means for reducing or eliminating thread spillage in sewing machines.

In lockstitch sewing machines, thread is pulled from the bobbin in small increments at each stitch. Each time this is done, the thread from the bobbin and thread supplied from a spool by way of a needle are locked together and pulled to the proper degree of tautness. In high speed machines, particularly those used in commercial operations, the number of stitches per minute is so great that the bobbin is in almost continuous rotary motion and may easily rotate too far in response to the small rotary impetus it receives at the occurrence of each stitch. This sometimes causes the bobbin to rotate so far forward, because of its angular inertia, that it unwinds an unnecessary amount of thread, which can then easily get tangled up with other parts of the thread or with some of the mechanical components in the region of the bobbin. This excess thread is said to be spilled out, and it is the prevention of such spillage that is a principle object of the present invention.

An additional factor leading to thread spillage is the use of relatively large bobbins which have a correspondingly large inertia. Once such a bobbin is given an incremental rotary impetus, it is more likely to continue to rotate than would a bobbin having a smaller inertia.

A further object of the present invention is to facilitate the use of larger bobbins with higher inertia than has been the case heretofore, and to permit such bobbins to be used in high speed sewing machines.

Various frictional devices have been used heretofore as brakes to limit the excess rotation of bobbins so as to prevent thread spillage. Several types of these devices are based on the concept of the use of a substantially flat spring between the end wall of the bobbin case and the adjacent bobbin flange. By using a spring that is deformed so that it exerts pressure in an axial direction on the inner surface at the end of the bobbin case and on the bobbin flange, a frictional force is produced on the bobbin flange that limits rotation in response to the incremental rotary motion imparted by the operation of removing a short length of thread from the bobbin at the occurrence of each stitch.

If such springs have no means of adjustment other than by being removed temporarily to be bent manually, or by means of a hand tool, it is difficult to cause them to produce the exact, desired braking effect. Instead, such devices tend to produce either too much or too little braking effect.

One way to improve control of the braking effect is to provide a threaded hole in the end wall of the bobbin case and to insert a screw into the threaded hole to press against the resilient member that applies frictional drag to the flange of the bobbin. The amount of pressure on the resilient member can be easily adjusted by turning the screw one way or the other. One such device is shown in U.S. Pat. No. 2,555,658, in which a generally J-shaped spring is attached to the inner part of the bobbin case by means of a small screw that passes through an eye at one end of the J-shaped spring. A second screw that adjusts the frictional drag is inserted in the same end structure of the bobbin case as the screw that holds the J-shaped spring in place.

One of the difficulties of the arrangement just described is that it requires two screws and the wall thickness of the end of the bobbin case has to be great enough at the locations of each of the screws to provide proper engagement between the screw threads and the threaded holes in the wall of the bobbin case.

It is not always possible to allow the end wall of the bobbin case to be sufficiently thick at the necessary locations to insert two separate screws, such as are used in the structure in U.S. Pat. No. 2,555,658, Supra. Accordingly, it is a further object of the present invention to reduce the number of parts while still retaining the ability to provide adjustable brake pressure in a bobbin case and to use a bobbin case having selective reduction of the wall thickness of the end wall at such points as are necessary to accommodate other features of the machine, such as an underbed thread trimmer.

SUMMARY OF THE INVENTION

In accordance with the present invention, a resilient braking member is provided in the form of an annular disc that has a small, central aperture that can be fitted over the hollow sleeve of a bobbin case and forced toward the end wall of the bobbin case to be between that end wall and the adjacent flange of the bobbin when the bobbin is put into the bobbin case. By making the size of the central aperture of the annular disc large enough to be forced onto the central sleeve, but small enough so that the annular disc cannot be removed easily from the central sleeve, the perimeter of the aperture grips the sleeve tightly enough so as not to fall off or even be displaced.

A small, threaded hole is provided in the end wall of the bobbin case between the central sleeve and the outer perimeter of the case, and a set screw is threaded into this hole. It is then a simple matter to adjust the braking effect by screwing the end of the set screw against the resilient member and urging a portion of that member against the adjacent flange of the bobbin. For smoothness of operation, it is desirable that the hole for the set screw be located well away from the central sleeve so that the pressure applied to the disc by this screw will be far enough from the central sleeve to produce a deflecting effect on the disc rather than tending to force the disc off of the central sleeve.

DESCRIPTION OF THE PREFERRED EMBODIMENT

Figure 1:
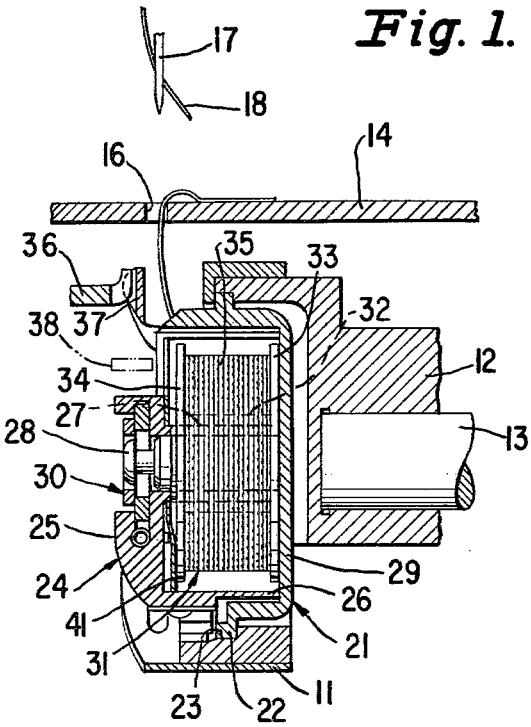
FIG. 1 is a cross-sectional view of a rotary hook of a sewing machine and a bobbin case holding a bobbin within the hook.

FIG. 1 shows a rotary hook 11 for a sewing machine. The hook is supported by a mount 12 on the end of a drive shaft 13, the axis of which coincides with the axis of the hook 11. The hook is located below a throat plate 14 that has an aperture 16 through which a needle 17 can carry a needle thread 18. A thread, or bobbin case carrier 21 is held in a fixed position within the hook 11, and the hook rotates around the carrier 21. For this purpose, the carrier 21 is provided with a peripheral flange 22 that fits into an annular raceway 23 in the hook 11.

A typical thread, or bobbin case 24 is shown held within the carrier 21. The case has a front wall 25 and a cylindrical skirt portion 26. A hollow central sleeve 27 extends from the inner surface of the front wall 25 parallel to, and in the same direction as, the skirt portion 26. The central sleeve 27 fits reasonably closely around a central stud 28 attached to a diameter bar 29 across the central part of the rear of the carrier 21. Standard latch means 30 are provided to hold the case 24 in place on the stud 28.

Within the case 24 is a bobbin 31 that has a hollow axle 32 journalled on the central sleeve 27. Two end flanges 33 and 34 extend radially from opposite ends of the axle 32, and the flanges and axle define a toroidal space of generally rectangular cross section in which bobbin thread 35 is wound.

In order to keep the case 24 from rotating with rotation of the hook 11, a positioning finger 36 extends from a fixed part of the sewing machine into engagement with a substantially radial slot 37 in the rim of the carrier 21 near the throat plate 14. The front wall of the thread case 24 just below the finger 36 in the position in which the thread case is installed for use has a reduced thickness to permit an underbed thread trimmer 38 to move across close to the thread case to cut the thread at selected times during the sewing process.

As may be seen, the front wall 25 is somewhat dome-shaped. This is especially clear in the lower part of the front wall indicated by reference numeral **25*a*. The central part of the front wall 25 has been cut away to provide room for the latch means 30, but the outermost parts of the latch means still lie substantially within a space that could be defined by continuation of the dome part 25*a* of the front wall 25. This structure is smooth and makes for good thread handling, since it is necessary for a loop of the needle thread 18 to slip across the surface and around the case 24** during the formation of stitches, as is well known in the sewing machine art.

The upper part **25*b* is not domed but is shown cut away or formed in such a way that it is relatively thin in the axial direction and relatively flat. If this part of the front wall were domed, as the lower part 25*a* is, there would be no room for the thread trimmer 38 to move into the position shown in phantom, as it must do at some point during a cycle of operation of the machine. The upper part 25*b* of the front wall 25 must be smooth for good thread handling, but the loop of thread formed by the needle thread 18 does not come into as close contact with this part of the case 24 as with the lower part 25*a* of the front wall. Therefore, it is detrimental to the operation of the machine incorporating a thread case 24 of the type shown in FIG. 1 to have the upper part 25 be of the front wall formed as shown. However, with the thin upper part 25*b***, it would be impossible to place a screw in that region, either to hold a brake member in place or to adjust the brake pressure.

Figure 2:
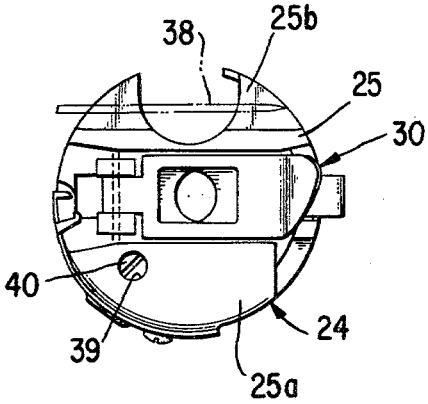
FIG. 2 is a plan view of the bobbin case in FIG. 1.

FIG. 2 shows the thread case 24 separately from any of the other parts of the machine in FIG. 1. A typical location reached by the underbed thread trimmer 38 at some point during the cycle of operation is shown in phantom. As may be seen, the trimmer 38 in this position would be in conflict with a screw placed at any point in the upper part **25*b* of the front wall 25**.

That is not true of the lower part **25*a* of the front wall 25. There, the front wall part 25*b* is thick enough to allow the formation of a threaded hole 39 to receive a screw 40. This is a headless, set screw driven far enough into the thick lower part 25*b* of the front wall so that it will not be engaged by the loop of needle thread 18 as that loop slides across the surface of part 25*b*** of the front wall.

Figure 3:
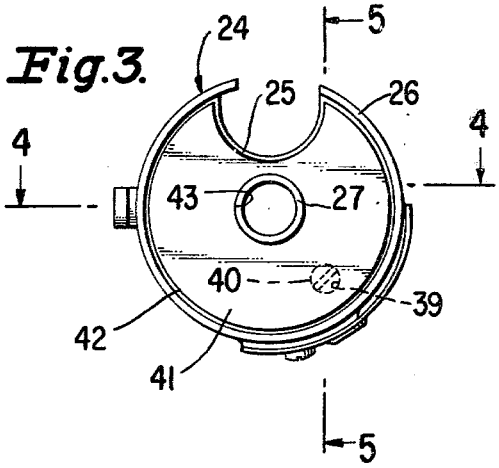
FIG. 3 is a rear view of the bobbin case in FIG. 2.

FIG. 3 shows the other side of the thread case 24. This is the back side and is the side that faces mount 12 when the thread case is inserted in the mount in a manner illustrated in FIG. 1. In this embodiment, substantially the entire inner surface of the front wall 25 is covered by an annular disc spring 41. Only a small peripheral part of the inner surface of the front wall 25 is visible in this figure. The disc 41 has an outer perimeter 42 spaced slightly inwardly from the inner surface of the skirt portion 26 of the thread case 24. In this embodiment, the disc 41 has a central aperture 43 that is circular and fits snugly around the central sleeve 27.

Figure 4:
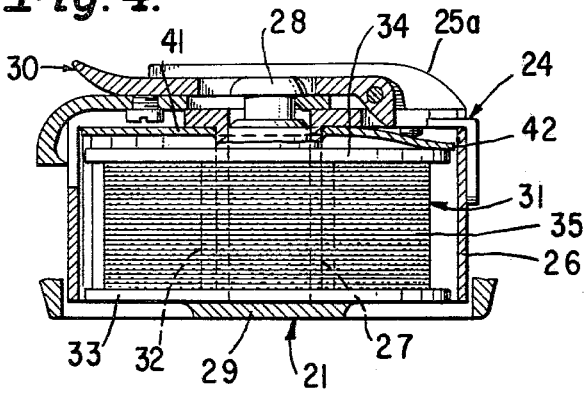
FIG. 4 is a cross-sectional view of the bobbin case along the lines 4—4 in FIG. 3.

FIG. 4 shows, somewhat enlarged, a cross-sectional view of the thread case 24, with the bobbin 31 therein, in place on the carrier 21. The latch means 30 is shown engaging the thread case supporting stud 28, and the domed part **25*a* of the front wall can be seen behind the latch means 30**.

The disc 41 is shown force fitted on the central sleeve 27, and the central aperture 43 in the disc 41 is enough smaller than the outer surface of the sleeve 27 so that a slight filleting of the edge surrounding and defining the aperture 43 occurs when the disc is pressed into place. This materially assists in holding the disc on the sleeve 27 in spite of any pressure that may be exerted by the screw 40. For a central sleeve 27 having an outer diameter of about 0.232", the diameter of the aperture of a high carbon steel disc 41 having a thickness of about 0.007" to about 0.009" may be between about 0.228" and 0.231".

Figure 5:
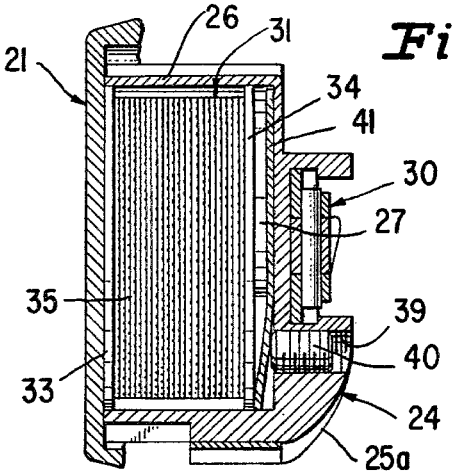
FIG. 5 is a cross-sectional view of the bobbin case in FIG. 3 along the lines 5—5.

FIG. 5 shows a different cross-sectional view of the thread case 24 in place on the carrier 21. This cross-section is taken in the plane of the axis of the set screw 40 and shows the screw pressing against the disc 41 with sufficient force to cause the disc to bear against the flange 34 of the bobbin 31. As may be seen, the length of the screw 40 is about equal to the thickness of part **25*a* of the wall 25. When the screw 40 is driven in far enough to press the disc 41 against the flange 34, it is important that no part of the screw extend beyond the outer surface of the part 25*a*** of the wall.

In operation, the needle 17 shown in FIG. 1 may move up and down quite rapidly. In the case of industrial sewing machines, several thousand stitches per minute may be formed. The needle 17 must move up and down once for each stitch, but the shaft 13 and the hook 11 attached to it must rotate twice for each stitch. With the formation of each stitch, a short length of the bobbin thread 35 must be unwound from the bobbin 31. Thus, the thread 35 is unwound in a series of jerks, but these jerks occur so rapidly that the bobbin 31 is in almost continuous rotation. In the absence of braking means, the effect of jerking the thread 35 to form each stitch may cause the bobbin to rotate much too far. The bobbin occasionally rotates so far that it starts to wind a length of the thread 35 backward. In that event, the bobbin thread may become so badly snarled that the machine must be stopped and the thread untangled.

Stoppage of the machine is most undesirable in industrial machines and must be prevented, if possible.

Figure 6:
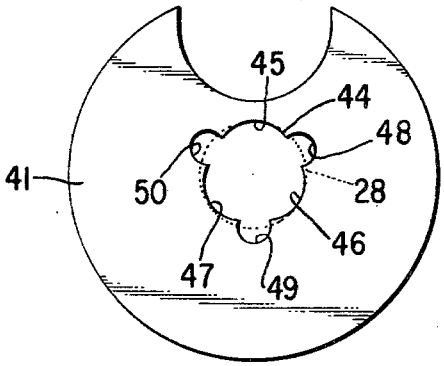
FIG. 6 shows an alternative form of resilient disc according to the present invention.

It is not necessary that the aperture 43 at the center of the disc 41 be circular. It may have other configurations, and one such configuration is shown in FIG. 6. In this figure, the central aperture 44 is formed on a series of main arcs 45–47 separated by smaller arcs 48–50. The other diameter of the central sleeve 27 is shown dotted to indicate its size in relation to the arcs 45–47. In this case, the arcs 45–47 are formed with smaller radii than the radius of the sleeve 28. In addition, the centers of these three arcs are slightly offset so that the metal at the corners of the arcs bites into the central sleeve 28. The small arcs 48–50 simply separate the larger arcs 45–47. Without such separation, there would only be three teeth at intersections of the arcs 45–47 to engage the central sleeve 27. However, no matter what the configuration of the central aperture 44 may be, it is desirable that the chordal distance between two points defining the aperture 44 and engaging the central sleeve 27 be separated, normally, by a distance greater than the chordal distance between the points on the sleeve 27 actually engaged by those parts of the perimeter of the aperture 44. This is true whether the aperture in the disc 41 is smooth and circular, as is the aperture 43 in FIG. 3, or rough, as is the aperture 44 in FIG. 6.

I claim:

1. A bobbin case for a sewing machine bobbin that comprises a hollow axle and a substantially radial flange at each end of the axle, the bobbin case comprising:

a hollow central sleeve to receive the hollow axle of the bobbin to permit guided rotation of the bobbin on the hollow sleeve;

a front wall extending substantially radially from one end of the hollow sleeve and rigidly attached to the sleeve, the front wall having a threaded opening extending through it at a location between the sleeve and the perimeter of the wall;

a substantially cylindrical skirt attached to and extending in the axial direction from the perimeter of the front wall in the same direction as the hollow sleeve;

a substantially flat, resilient, annular brake member having a central aperture forcibly fitted onto the central sleeve adjacent the inner surface of the front wall, the outer perimeter of the brake member being spaced from the substantially cylindrical skirt portion to allow limited axial movement of the perimeter of the brake member; and a screw threaded into the opening in the front wall and engaging the surface of the brake member facing the front wall, the screw being adjustable to exert a controllable pressure against the brake member to force the brake member against the end surface of the proximal flange of the bobbin to exert a controllable braking effect on the bobbin.

2. The invention as defined in claim 1 in which the central sleeve has a substantially round external surface, and the central aperture of the brake member is also round and has a diameter that forms in interference fit with the outer suface of the central sleeve.

3. The invention as defined in claim 1 in which the central sleeve has a circular external surface, and the central aperture of the brake member is non-circular and comprises regions defining chordal distances therebetween less than the chordal distances between those parts of the circular surface of the central sleeve engaged thereby when the brake member is forceably fitted on the central sleeve.

4. The invention as defined in claim 1 in which the bobbin case further comprises a latch pivotally mounted near one side of the front wall and extending substantially diametrically across the front wall and being at least partly recessed into the front wall to separate the front wall into first and second portions on opposite sides of the latch, the threaded aperture being located in the first portion of the front wall, a substantial part of the first portion of the front wall having a thickness greater than the length of the screw, and most of the second portion of the front wall on the other side of the latch having a thickness less than the length of the screw.

* * * * *